US006865984B2

(12) United States Patent
Schürmann et al.

(10) Patent No.: US 6,865,984 B2
(45) Date of Patent: Mar. 15, 2005

(54) PRESS, ESPECIALLY SINGLE-LEVEL OR MULTILEVEL OF CONTINUOUS PRESS

(75) Inventors: Klaus Schürmann, Jüchen (DE); Lothar Sebastian, Duisburg (DE); Horst Weiss, Krefeld (DE); Werner Gawlitta, Tegelen (NL)

(73) Assignee: Siempelkamp Maschinen- und Anlagenbau GmbH & Co. KG, Krefeld (DE)

( * ) Notice: Subject to any disclaimer, the term of this patent is extended or adjusted under 35 U.S.C. 154(b) by 0 days.

(21) Appl. No.: 10/319,804

(22) Filed: Dec. 13, 2002

(65) Prior Publication Data

US 2003/0110960 A1 Jun. 19, 2003

(30) Foreign Application Priority Data

Dec. 14, 2001 (DE) ..... 101 61 489

(51) Int. Cl.[7] ..... B30B 13/00; B30B 1/32

(52) U.S. Cl. ..... 100/35; 100/194; 100/269.17; 156/580; 29/463

(58) Field of Search ..... 100/214, 269.17, 100/299, 35; 72/455, 456, 453.01, 389.5, 482.3, 482.4; 29/463, 465, 428; 425/406, 338

(56) References Cited

U.S. PATENT DOCUMENTS

| | | | | | |
|---|---|---|---|---|---|
| 3,783,774 | A | * | 1/1974 | Groos et al. | 100/214 |
| 4,207,048 | A | * | 6/1980 | Seymour | 425/151 |
| 4,590,784 | A | * | 5/1986 | Okabe et al. | 72/389.3 |
| 4,591,089 | A | * | 5/1986 | Berchem | 228/107 |
| 4,615,208 | A | * | 10/1986 | Hailey | 72/455 |
| 5,027,638 | A | * | 7/1991 | Friestad | 72/455 |
| 5,394,723 | A | * | 3/1995 | Benz | 72/163 |
| 5,787,564 | A | * | 8/1998 | Herpst et al. | 29/463 |

FOREIGN PATENT DOCUMENTS

DE 197 40 325 5/1998

* cited by examiner

*Primary Examiner*—Allen Ostrager
*Assistant Examiner*—Jimmy T Nguyen
(74) *Attorney, Agent, or Firm*—Herbert Dubno

(57) ABSTRACT

A single-level or multilevel or continuous board press is composed of a succession of press frames which are subdivided horizontally at their vertical limbs for transport and when then welded together at the erection site. Leveling strips are provided along mounted surfaces of the frame to support the plates, piston-and-cylinder units and the like serving to press the mats of wood material.

13 Claims, 7 Drawing Sheets

PRESS, ESPECIALLY SINGLE-LEVEL OR MULTILEVEL OF CONTINUOUS PRESS

FIELD OF THE INVENTION

The present invention relates to a press and particularly a board press, i.e. a single-level press, a multilevel press, a continuous press or the like for pressing mats of wood material into pressed board of large sizes. The invention in particular relates to a press of the type described having a multiplicity of press frames arrayed in succession along the length of the press.

BACKGROUND OF THE INVENTION

In multi-frame presses of the aforedescribed type for the production of pressed board, i.e. chipboard, fiber board or particle board in which wood particles, pieces or fibers are pressed together and generally bonded together with the aid of an adhesive which can be activated by an elevated temperature produced in the press, the pressing usually is effected between upper and lower press plates and the press can have a bed plate and a head plate which can form press plates as well. In a continuous press steel belts usually carry the mat to be pressed between the press plates and, where required or desired, arrays of rollers may be interposed between each belt and the upper and lower plate.

The press support can be comprised of a plurality of frames as noted with each frame having a pair of lateral shanks or press limbs connecting together an upper horizontal frame limb and a lower horizontal frame limb. The upper and lower frame limbs may be referred to as upper and lower beams and generally provide mounting surfaces at the head portion and foot portion of the frame upon which the press plate or bed or the head plate of the press can be braced or supported and/or against which a piston-and-cylinder arrangement can be braced or fastened to enable at least one press plate, bed or head to be displaced to compress the mat between the pressing surfaces.

It has been proposed in the past to subdivide the press frames and thereby form two frame halves which can be connected together.

Such presses utilize press frames which are commonly designed for large presses and very large presses like, for example, 12 foot presses and create significant transport costs when the parts of the press have to be moved from the manufacturing site to an erection site. With the largest presses, namely, multi level presses in which the frames are subdivided vertically, the frame segments are very long and the subdivision of the frame is normally effected in the regions of the head part or the foot part of the individual frame. In these regions, which take up the bulk of the pressing force, special configurations are required for frame stability. For example, connecting flanges have had to be welded at the separations of the frames (see, for example, DE 44 41 063).

In such embodiments, the transport problems are enhanced not only because of the size of the pieces which must be transported but because the weight of the pieces greatly increases the individual frame weight and the complexity of the frames at the junctions of the parts thereof increases the complexity of assembly. Furthermore, the bolt connections hitherto provided between the flanged portions of the frame head or frame foot of the divided frame are not free from disadvantages in stability of the frame in the liability for long term pressing operations, in shape stability and even overall durability, especially for multilevel presses.

A further disadvantage, apart from the greater weight of the press frame when it is assembled, such vertically divided frame constructions must be reinforced because by comparison with closed frame constructions, no corner moments can be activated.

OBJECTS OF THE INVENTION

It is the principal object of the present invention to provide a press, especially a press of the type described, whereby the frame construction can be improved so as to have enhanced durability and shaping retentativeness while reducing the frame weight and cost of material used in its publication.

Another object of the invention is to provide a press, especially a single-level or multi-level press, a continuous press or the like and particularly a board press for pressing particle boards as defined previously, which can be erected more readily at the press installation site and is easier to transport to that site.

A further object of this invention is to provide an improved press frame for a press of the type described at the outset which is free from the drawbacks mentioned and can be erected at the installation site easily and inexpensively, while nevertheless provided a high degree of durability and shape stability, eliminating drawbacks of prior art systems.

Still another object is to provide an improved method of making such a frame.

It is also an object of the invention to provide an improved apparatus for use in the making of the improved frame.

SUMMARY OF THE INVENTION

These objects and others which will become apparent hereinafter are attained, in accordance with the invention in a board press for producing press board which comprises:

a press stand comprised of a plurality of upright press frames composed of steel plate and each having a generally horizontal upper limb, a generally horizontal lower limb and a pair of generally vertical lateral limbs interconnecting the upper and lower limbs, the frames each being subdivided horizontally into at least two segments and having at each lateral limb at least one welding gap between the two segments at which the segments are welded together, the upper limbs defining upper horizontal mounting surfaces and the lower limbs defining horizontal lower mounting surfaces;

respective pressing members braced against the upper mounting surfaces and against the lower mounting surfaces and selected from press plates and piston-and-cylinder arrangements whereby board is pressed between the pressing members; and leveling strips between the mounting surfaces and the members for compensating for frame distortion.

Advantageously the segments of each frame are frame halves and the welding gaps are each double-V-section welding gaps. The strips can be prefabricated elements having predetermined configurations based upon configurations of the completed welded frames and may have curved surfaces, the strips being fastened to the surface by insulators or isolators. The method of making frames can comprise the steps of:

(a) fabricating at least two frame segments of each frame such that each frame is subdivided horizontally and has at each lateral limb at least one welding gap between the two segments;

(b) shipping the frame segments to a site at which the press is to be erected;

(c) welding the segments of each frame together at the site by filling the gaps with weldment to form the frames of the press and such that the upper limbs define upper horizontal mounting surfaces and the lower limbs define horizontal lower mounting surfaces; and (d) affixing leveling strips on the upper horizontal mounting surfaces and the lower horizontal mounting surfaces for compensating for frame distortion.

The device for use in this method can include a positioning unit or a jig having abutments against which the abutment surfaces of the segments for welding. Weldment is deposited in the gaps on one side, the jig is rotated about an axis, and weldment is then deposited in the gaps from an opposite side.

According to the invention, a board press for producing pressed board comprises a plurality of upright press frames composed of steel plate and each having a generally horizontal upper limb, a generally horizontal lower limb and a pair of generally vertical lateral limbs interconnecting the upper and lower limbs, and the device has a positioning unit for receiving at least two frame segments of each frame such that each frame is subdivided horizontally and has at each lateral limb at least one welding gap between the two segments. The device comprises hold-down elements for retaining the segments and abutment surfaces for aligning the segments whereby the frame segments can be welded together at the site by filling the gaps with weldment to form the frames of the press.

According to the invention, therefore, for a press of the type described at the outset, especially a single-level or multi-level press, a continuous press or the like in which the press support is a row of press frames formed with frame upper and lower members and horizontal separations in the respective vertical limbs between the upper and lower segments which are then welded together at the erection site, the mounting surfaces formed by the upper and/or lower segment can be provided with levelling bars or pieces which serve for the mounting of the press plate or press plates and/or piston-and-cylinder units and/or of upper and lower beds or beams to compensate for frame distortion.

According to the principles of the present invention, the two frame segments of each closed frame construction are readily transported to the erection site from the fabrication site since the frame segments are shorter than those which have been transported heretofore even when the frames are of very large dimensions. The closed frame construction which results from the welding enables activation of the corner moments which permits a weight reduction with increased durability and shape stability of the press frames and thus of the press.

The welding of the upper frame segment and the lower frame segment together in regions of the horizontal separations through the vertical shanks or limbs can be readily accomplished at the erection site. To insure a high precision in such welding, with a minimum distortion in terms of shrinkage or the like, the method of the invention can provide that the two frame segments are locked into a positioning device or jig. When the welding is effected in a double-V-gap or an X shaped gap, it is possible to keep the shrinkage of the frame at the order of millimeters. The shrinkage and distortion is ready compensated by the levelling bar or pieces or sometimes referred to hereinafter as shims. The segments preferably are half frames.

It has been found to be desirable, in some cases, to provide more than one weld seam in the vertical shank, especially for a multilevel press which is rather high. In that case, the weld seams should be close to the upper and lower limbs of the frame.

The levelling bars or pieces can be prefabricated with a curved surface defined to compensate for distortion when the amount of distortion is known although frequently milling of the shims may be required to more precisely compensate for the distortion after the welding has been completed and the frame is stable. The piston-and-cylinder units, plates, bed and head of the press can be mounted upon erection of the welded frames.

It has been found to be advantageous, especially in the case of multilevel presses to provide each frame as a binary frame of two frame members which are coextensive with one another and are held together at least in the corner regions by tiebolts and spacers. This allows the piston-and-cylinder units to be received between the two frame members with a two point mounting.

BRIEF DESCRIPTION OF THE DRAWING

The above and other objects, features, and advantages will become more readily apparent from the following description, reference being made to the accompanying drawing in which.

SPECIFIC DESCRIPTION

Figure 6:
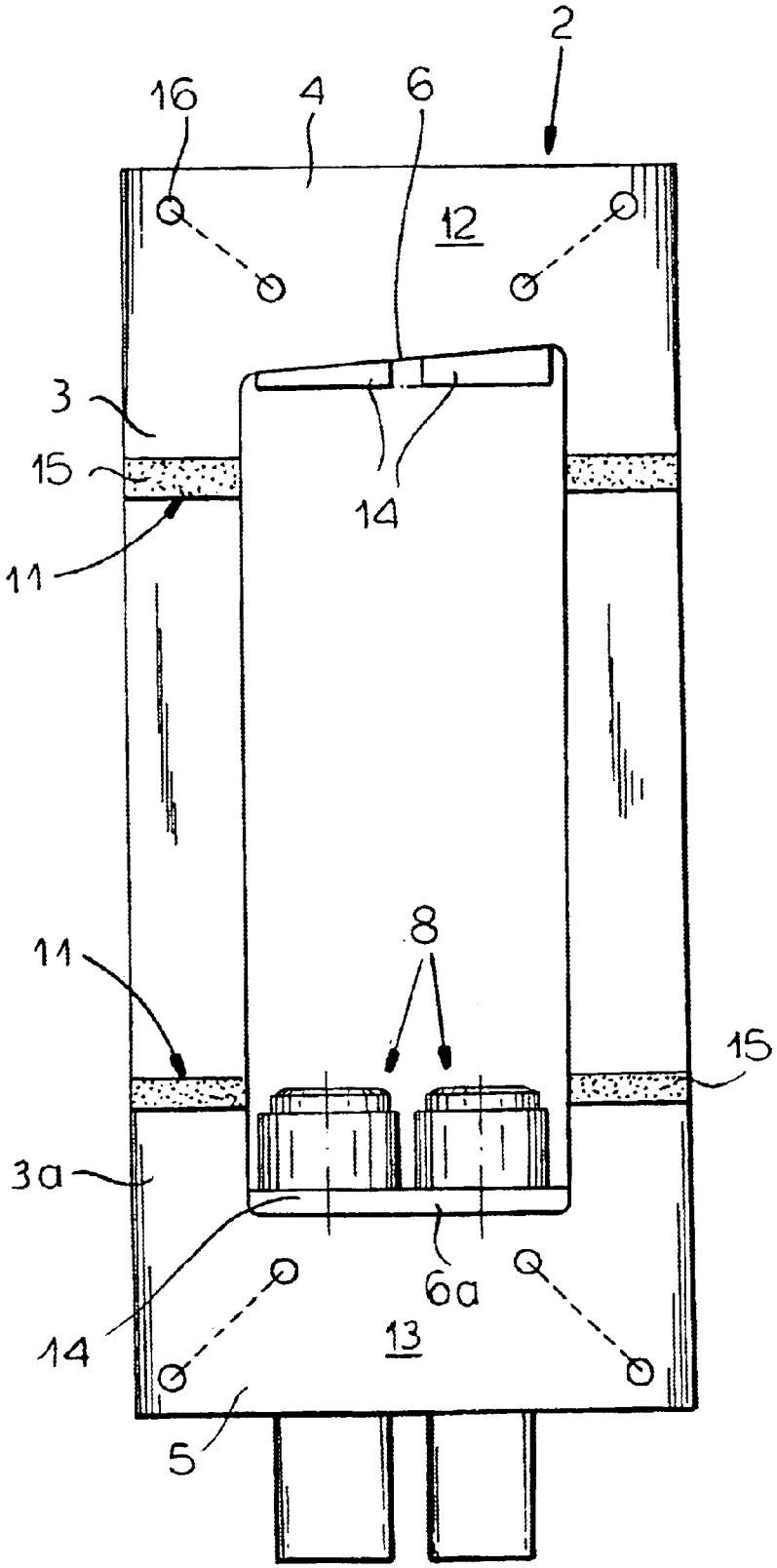
FIG. 6 is a schematic front elevational view of a press frame for a multilevel press.
Figure 7:
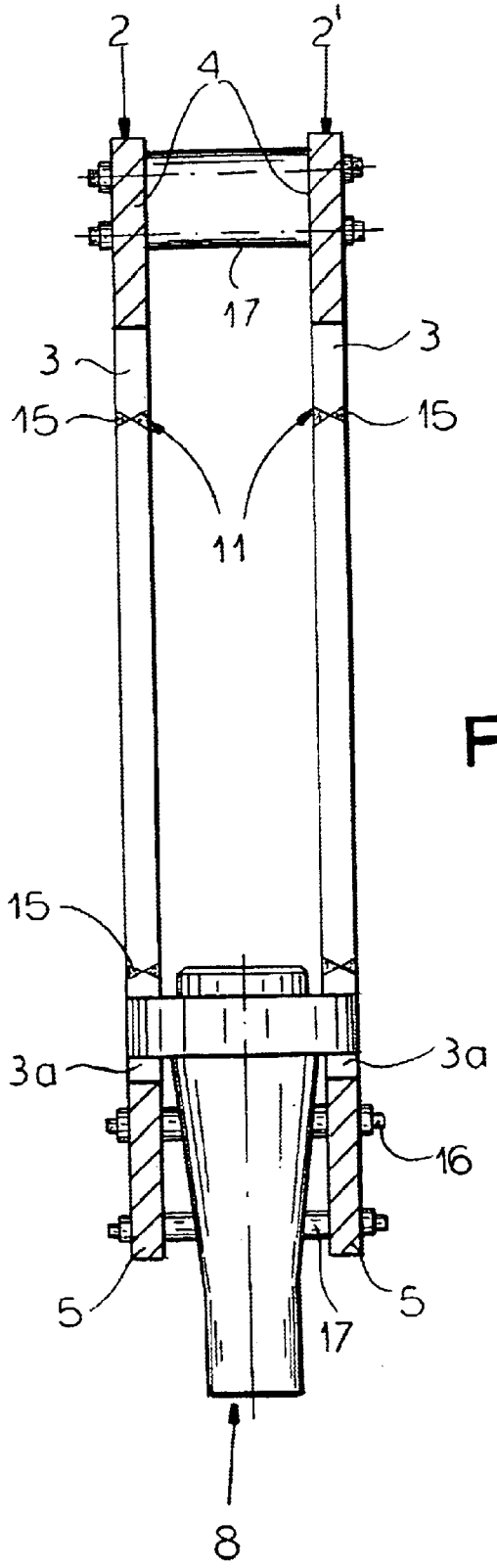
FIG. 7 is a side view in vertical section through the frame of FIG. 6 showing the two-part nature thereof.
Figure 8:
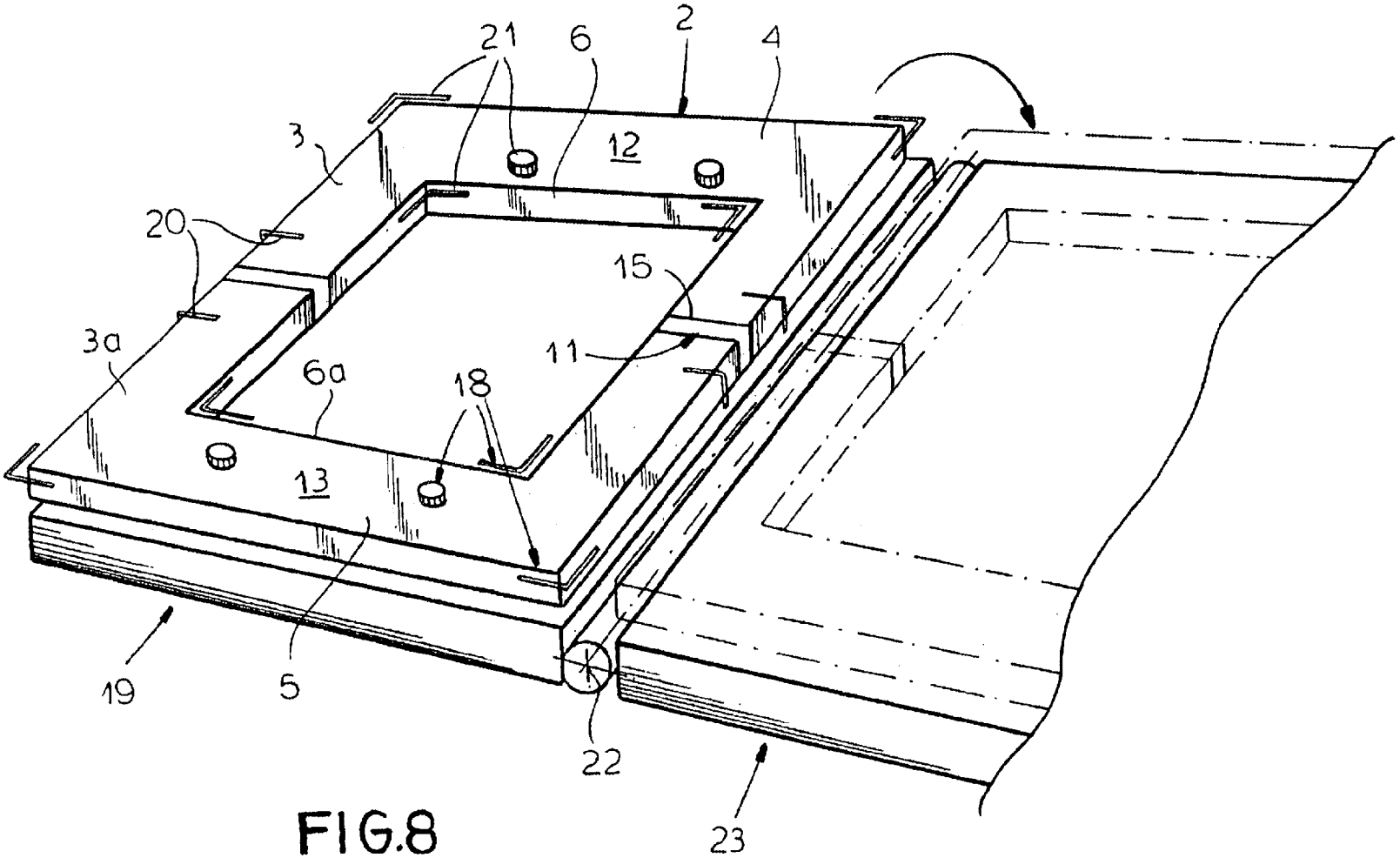
FIG. 8 is a partial perspective view illustrating a jig or device for fabricating a frame according to the invention from frame segments.
Figure 9:
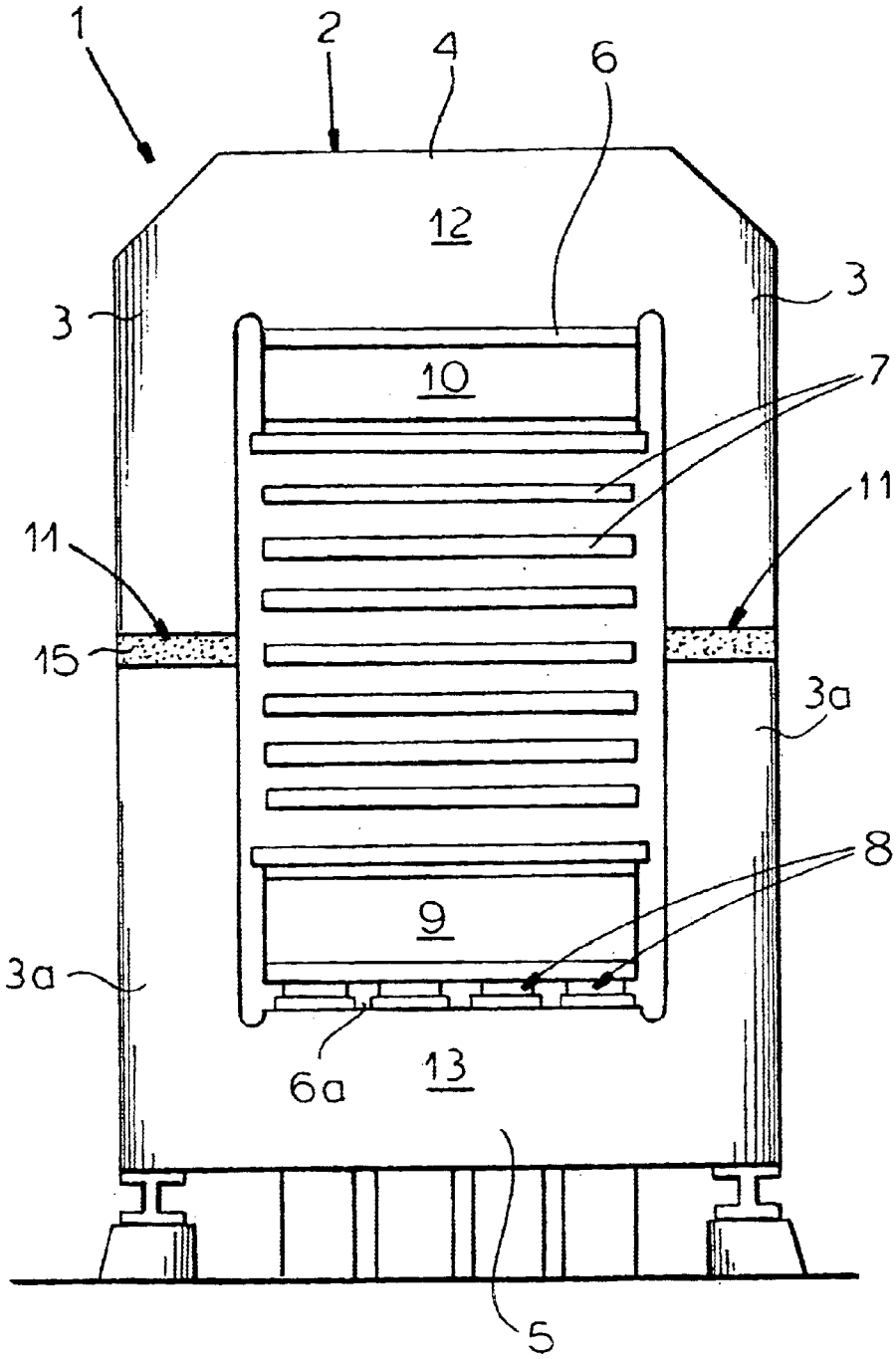
FIG. 9 is a schematic front elevational view of a multilevel press embodying the invention.
Figure 10:
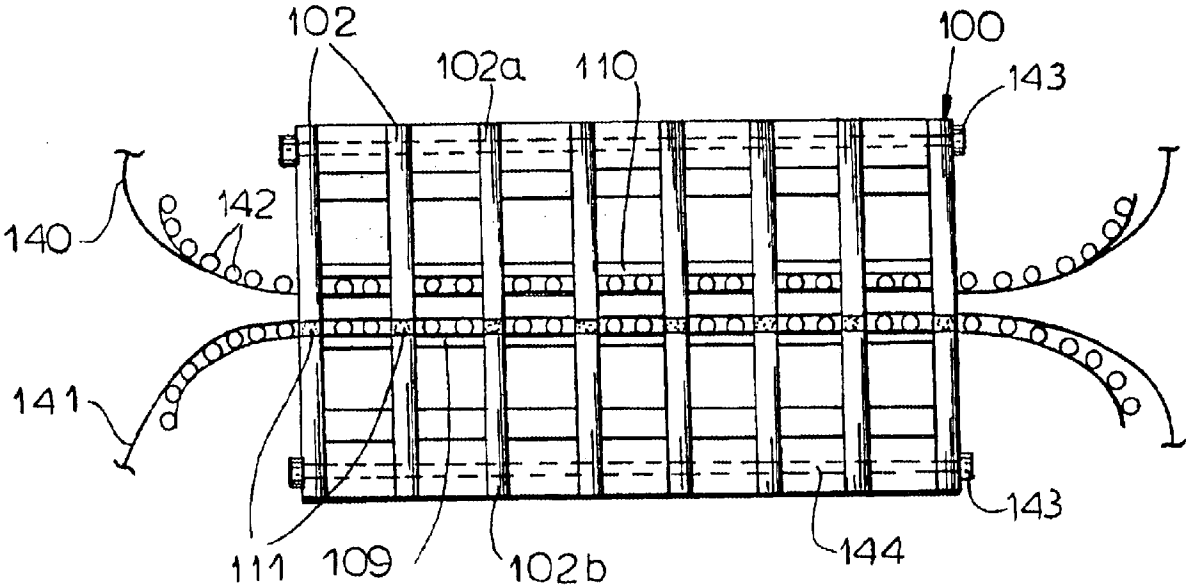
FIG. 10 is a side view in part showing a continuous press according to the invention.

Presses utilizing the frames of the invention are shown in FIGS. 9 and 10 and from FIG. 10 it will be apparent that a board press 100 according to the invention can comprise a plurality of press frames 102 which are spaced apart along the length of the press, provide a bed plate 109 and a head plate 110 between which a mat of wood particles and a binder can be hot-pressed. In the embodiment of FIG. 10 the press is a continuous press in which a pair of steel belts 140, 141 draw the mat between them and ride via rollers 142 on the surfaces of the bed and head to compress the mat. The bed and head are supported on mounting surfaces of the frames which may be held together by rods 143 with spacers 144 disposed between the frames. Each frame may be a binary frame as shown in FIGS. 6 and 7 and the mounting surfaces formed by the frames may support piston and cylinder units as shown for the multilevel presses of FIGS. 6, 7 and 9. The frames 102 are formed from upper and lower frame halves 102*a*, 102*b* joined together at weld seams 111 as will be apparent hereinafter. The press is designated at 1 in FIG. 9.

The presses thus shown in the drawing are single level or multilevel presses or continuous presses for the production of large size particle board, namely, chip board, fiberboard or like wood-based construction board. Such presses 1 or 100 have a press support which is comprised of a plurality of press frames 1, 102 arranged in a row.

Figure 1:
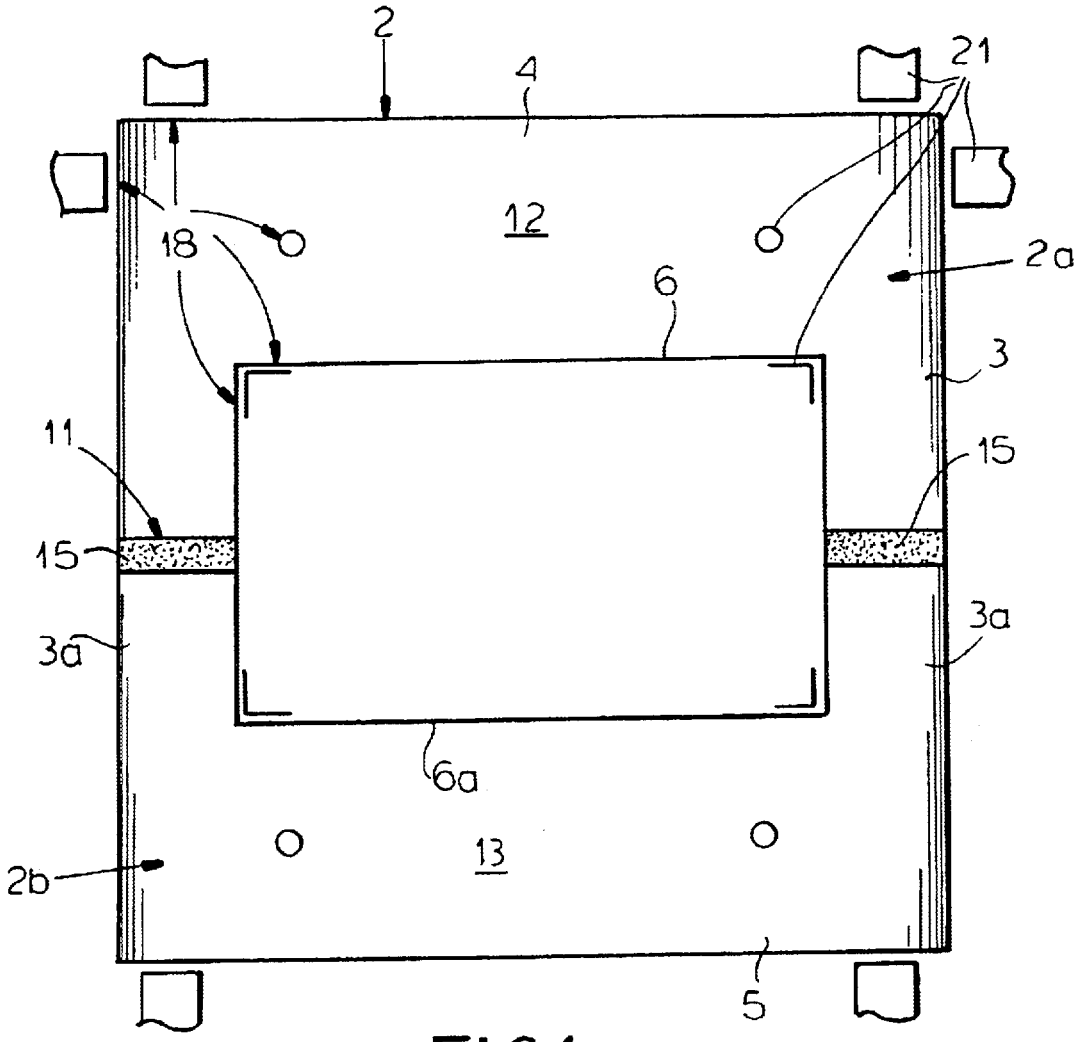
FIG. 1 is a vertical elevational view, somewhat in diagrammatic form, of one press frame for a press according to the invention seen in a front view and with positioning elements diagrammatically indicated relative to that frame.
Figure 2:
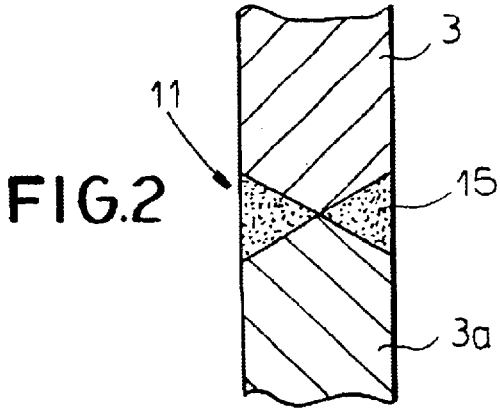
FIG. 2 is a cross sectional view through the frame of FIG. 1 in the region of one of the weld seams.
Figure 3:
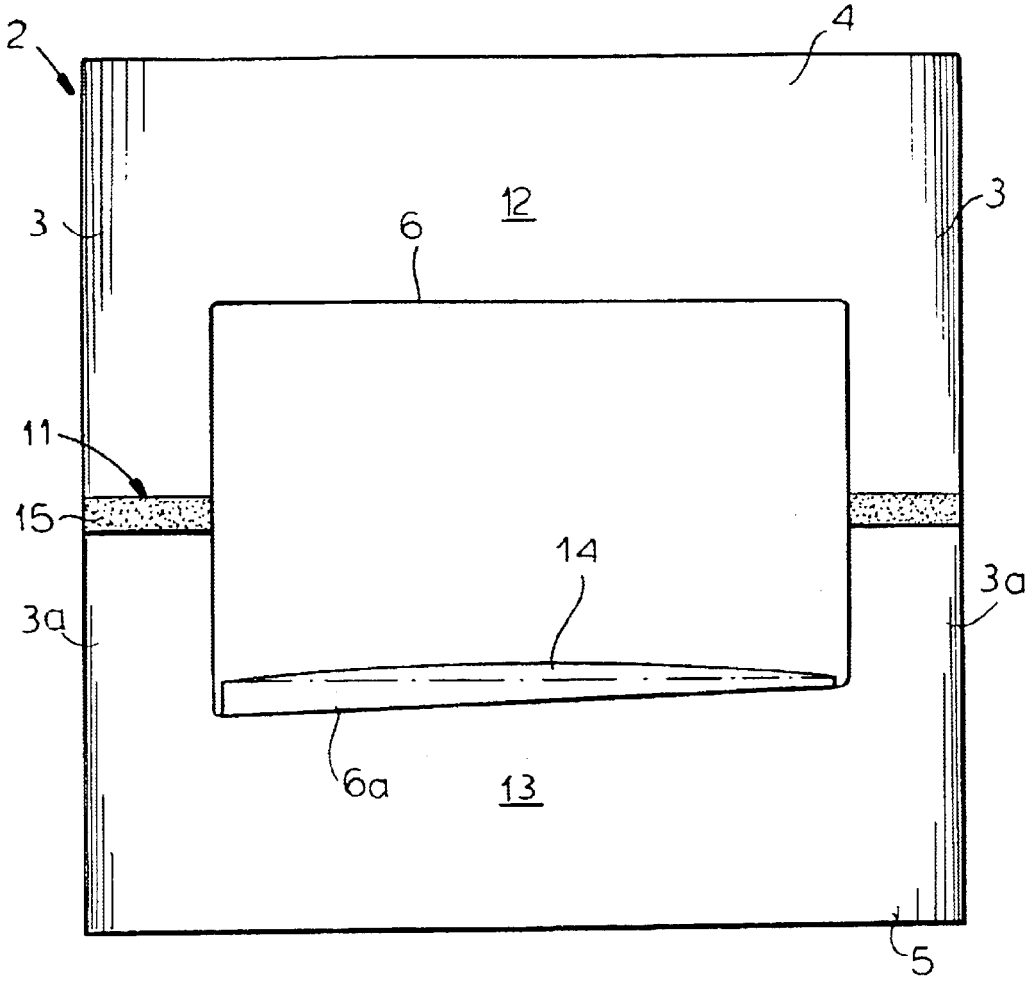
FIG. 3 is a view similar to FIG. 2 but with the positioning elements omitted showing the welded frame with a leveling strip in place.

The press frames 2, 102 are respectively made from steel plate and in the embodiments illustrated are comprised of two segments 2*a* and 2*b* which are frame halves and have each a pair of lateral frame shanks or limbs 3, 3*a* connected respectively to an upper limb or beam 12 and a lower limb or beam 13. The upper limbs 12 of the frame form the head 4 and the lower limbs 13 form the foot 5 of each frame and the press. The frames within the limbs have substantially horizontal mounting surfaces 6, 6*a* for at least one press plate 7 and at least one piston-and-cylinder arrangement 8 for actuating at least one press plate for compressing the board between the head 10 and he bed 9. Each press frame 2 is thus subdivided by a gap 11 which is filled with weldment by means of which the shanks 3 are welded to the shanks 3*a* to complete the lateral limbs and form the respective horizontal weld seams. The frame halves are thus connected together in force-transmitting relationship to complete shape-stable frames. The press frame 2 which has been shown in FIGS. 1 and 2 as suitable for a single level press in principle can be a press frame for a multilevel or continuous press as has been described, will have upper and lower frame limbs 12 and 13 connected by the lateral limbs 3, 3*a* through the respective weld seams and define mounting surfaces 6 or 6*a* which may not be strictly parallel or may not be of the design shape for the frame because of possible distortion on welding and assembly of the segments.

As a consequence, leveling strips or pieces 14 are provided between the mounting surfaces 6, 6*a* and the press plate 7 and/or the piston-and-cylinder units 8 or between the limbs 12 and 13 and the head plate 10 or base plate 9 to compensate for frame distortion or misalignment.

Figure 4:
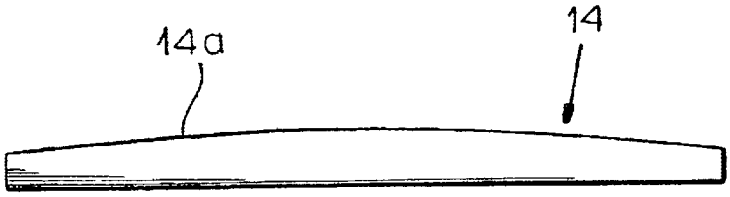
FIG. 4 is an elevational view showing a prefabricated curved leveling strip which can be used with a press frame.
Figure 5:
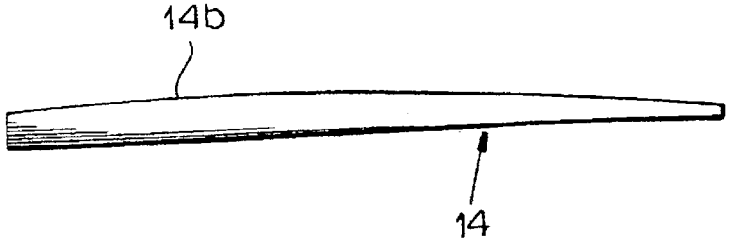
FIG. 5 is an elevational view of the leveling strip of FIG. 4 which has been corrected for the particular press by, for example, a corrective milling operation.
Figure 11:
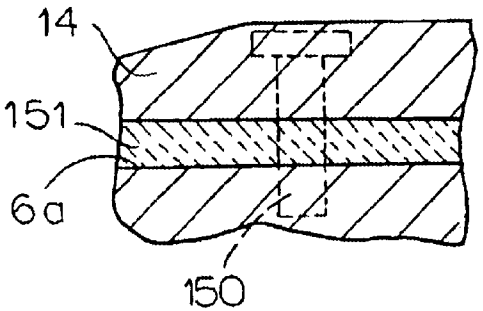
FIG. 11 is a cross sectional detail view showing the mounting of a leveling strip or piece according to the invention.

As can be seen from FIG. 11, the strips or shims 14 can be secured to the mounting surface 6*a* by countersunk bolts 150 via an insulator or isolator 151. The gaps 11 which are filled with weldment to form the weld 15 may be of double-V shape or have the configuration of an X. The strips 14 can be prefabricated elements (see FIG. 4) and can have a curve at 14*a* which, for example, can be precalculated to be the configuration necessary to compensate for the distortion. Alternatively, the shim may be trimmed by milling to provide the surface 14*b* (FIG. 5) when the distortion requires it for perfect leveling of the plate or piston-and-cylinder arrangement which is to be supported thereon.

Especially for relatively high presses like multilevel presses, it may be desirable to subdivide the vertical shanks or limbs a number of times and provide a plurality of weld seams along these shanks or vertical limbs as has been shown in FIG. 6. It is advantageous in such cases to fabricate each frame as a binary frame with two coextensive frame structures 2 and 2' which are joined together as can be seen in FIGS. 6 and 7 by tie bolts 16 with intervening spaces 17. In this case, the piston-and-cylinder 8 can be provided with a two-point support between the two individual frames 2 and 2'. Each of the individual frames may be welded together at the seams 15.

The segments to be welded together are transported to the erection site and are positioned on a jig 19 against abutment surfaces 18 to line up the shanks 3 and 3*a* and provide an upwardly open weld gap. The segments are held in place by hold-down elements 20 and abutments 21 for the abutment surfaces 18 on the frame segments. The welding head deposits the weldment in the gap on one side of the frame, whereupon the positioning device 19 is swung through 180° about the axis 22 to position the frame in a mirror-symmetrical manner on the positioning device 23 for the welding of the gaps 11 from the opposite side.

We claim:

1. A board press for producing pressed board, comprising:

a press stand adapted to receive press plates and comprised of a plurality of upright press frames composed of steel plate and each having a generally horizontal upper limb, a generally horizontal lower limb and a pair of generally vertical lateral limbs interconnecting the upper and lower limbs, said frames each being subdivided horizontally into at least two segments and having at each lateral limb at least one horizontally extending welding gap between the two segments at which said segments are welded together, said upper limbs defining upper horizontal mounting surfaces and said lover limbs defining horizontal lower mounting surfaces whereby two frame segments welded together at said gags form a respective closed press frame with one another;

respective pressing members braced against said upper mounting surfaces and against said lower mounting surfaces and selected from press plates and piston-and-cylinder arrangements whereby board is pressed between said pressing members; and leveling strips are provided between said mounting surfaces and said members for compensating for frame distortion.

2. The press defined in claim 1 wherein said segments of each frame are frame halves.

3. The press defined in claim 1 wherein said welding gaps are each double-V-section welding gaps.

4. The press defined in claim 1 wherein said strips are prefabricated elements having predetermined configurations based upon configurations of the mounting surfaces of the completed welded frames.

5. The press defined in claim 4 wherein said strips have curved surfaces.

6. The press defined in claim 1 wherein said strips are fastened onto said surfaces through the intermediary of insulators.

7. The press defined in claim 1 wherein each of said lateral limbs has a plurality of horizontal subdivisions forming respective weld gaps at which parts of said lateral limbs are welded together by horizontal weld seams.

8. The press defined in claim 1 wherein each of said frames comprises a pair of substantially coextensive frame units joined together at corners thereof with respective tie bolts and spacers.

9. The press defined in claim 8 wherein a respective two-point support is provided between the respective frame units of each frame and at least one of said piston-and-cylinder arrangements.

10. A method of making frames for a board press for producing pressed board and wherein the press comprises a plurality of upright press frames composed of steel plate and each having a generally horizontal upper limb, a generally horizontal lover limb and a pair of generally vertical lateral limbs interconnecting the upper and lower limbs, said method comprising the steps of:

(a) fabricating at least two frame segments of each frame such that each frame is subdivided horizontally and has at each lateral limb at least one horizontally extending welding gap between the two segments;

(b) shipping said frame segments to a site at which the press is to be erected;

(c) welding the segments of each frame together at said site by filling said gaps with weldment to form the frames of said press and such that said upper limbs define upper horizontal mounting surfaces and said lower limbs define horizontal lower mounting surfaces whereby two frame segments welded together at said gaps form a respective closed press frame with one another; and (d) affixing leveling strips on said upper horizontal mounting surfaces and said lower horizontal mounting surfaces for compensating for frame distortion.

11. The method defined in claim 10 wherein said segments are positioned against abutment surfaces for alignment at said site for welding said segments together.

12. The method defined in claim 11, further comprising the step of preparing surfaces of said lateral limbs for welding prior to deposition of said weldment in said gap.

13. A method of making frames for a board press for producing pressed board and wherein the press comprises a plurality of upright press frames composed of steel plate and each having a generally horizontal upper limb, a generally horizontal lower limb and a pair of generally vertical lateral limbs interconnecting the upper and lower limbs, said method comprising the steps of:

(a) fabricating at least two frame segments of each frame such that each frame is subdivided horizontally and has at each lateral limb at least one horizontally extending welding gap between the two segments;

(b) shipping said frame segments to a site at which the press is to be erected;

(c) welding the segments of each frame together at said site by filling said gaps with weldment to form the frames of said press and such that said upper limbs define upper horizontal mounting surfaces and said lower limbs define horizontal lower mounting surfaces whereby two frame segments welded together at said gaps form a respective closed press frame with one another; and (d) affixing leveling strips on said upper horizontal mounting surfaces and said lower horizontal mounting surfaces for compensating for frame distortion, said segments being positioned against abutment surfaces for alignment at said site for welding said segments together, said segments being mounted on a jig against said abutment surfaces for welding, weldment being deposited in said gaps on one side, said jig being rotated about an axis, and weldment then being deposited in said gaps from an opposite side.

* * * * *